US006752265B1

(12) United States Patent
Draghetti et al.

(10) Patent No.: US 6,752,265 B1
(45) Date of Patent: Jun. 22, 2004

(54) PACKET FOR ARTICLES OF ELONGATED SHAPE

(75) Inventors: Fiorenzo Draghetti, Medicina (IT); Chiara Colo' , Fiumalbo (IT); Angelo Li Vigni, Bologna (IT)

(73) Assignee: G.D. S.p.A., Bologna (IT)

( * ) Notice: Subject to any disclaimer, the term of this patent is extended or adjusted under 35 U.S.C. 154(b) by 0 days.

(21) Appl. No.: 09/625,637

(22) PCT Filed: Nov. 30, 1999

(86) PCT No.: PCT/IB99/01905

§ 371 (c)(1),
(2), (4) Date: Jul. 25, 2000

(87) PCT Pub. No.: WO00/32499

PCT Pub. Date: Jun. 8, 2000

(30) Foreign Application Priority Data

Dec. 2, 1998 (IT) ..... B098A0678

(51) Int. Cl.[7] ..... B65D 85/10
(52) U.S. Cl. ..... 206/271; 40/312; 283/102
(58) Field of Search ..... 206/268, 271, 206/273, 459.1, 831; 229/160.1, 87.13; 783/94, 100, 102; 40/312

(56) References Cited

U.S. PATENT DOCUMENTS 223,432 A * 1/1880 Brooks ..... 40/312
4,597,591 A * 7/1986 Gendron et al. ..... 283/102
4,717,017 A 1/1988 Sprinkel, Jr. et al.
4,771,882 A * 9/1988 Lowe et al. ..... 206/268
5,105,969 A 4/1992 Lamas
5,826,785 A * 10/1998 Belvederi et al. ..... 206/273
6,138,823 A * 10/2000 Focke et al. ..... 206/268

FOREIGN PATENT DOCUMENTS

GB 2 193 186 2/1988

* cited by examiner

*Primary Examiner*—John G. Weiss
*Assistant Examiner*—Michael J. Fisher
(74) *Attorney, Agent, or Firm*—Davidson Berquist Klima & Jackson, LLP

(57) ABSTRACT

A cigarette packet includes a first inner wrapper (2) enveloping a group of cigarettes, a second outer wrapper (5) wrapped around the first inner wrapper (2), a revenue stamp (14) and, in the event that the packet (1) is of the rigid type with a hinged lid, a reinforcing frame (10), all identifiable as specific packaging components of the packet (1). The packet (1) includes a layer (16) of opaque material, removable by scratching, which is designed to conceal at least one predetermined message or image (18) on at least one predetermined area (17) of at least one of the specific packaging components (13).

6 Claims, 3 Drawing Sheets

PACKET FOR ARTICLES OF ELONGATED SHAPE

This application is the national phase of international application PCT/IB99/01905 filed Nov. 30, 1999 which designated the U.S.

TECHNICAL FIELD

The present invention relates to a packet for articles of elongated shape.

More particularly, the present invention relates to a packet for tobacco products such as cigarettes, cigars or the like, to which reference will be made throughout the following specification albeit with no limitation in scope implied; such a packet can be either of the soft type, or the rigid type with a hinged lid.

BACKGROUND ART

Generally speaking, the soft or 'crush' type of cigarette packet is substantially parallelepiped in appearance and comprises an inner wrapper usually of paper or metal foil, fully enveloping a group of cigarettes, and an outer wrapper or label fashioned from a sheet of material, generally paper, folded in part about the inner wrapping in such a way that the top face of this same inner wrapping remains exposed.

Similarly, a conventional cigarette packet of the rigid type with a hinged lid appears substantially as a rectangular parallelepiped and comprises an outer wrapper of box-like embodiment fashioned from a precreased flat diecut blank, generally card or paperboard, also an inner wrapper normally of paper or metal foil accommodated internally of the outer wrapper, fully enveloping the group of cigarettes and identical in shape to the inner wrapper of the soft type of pack.

The box-like outer wrapping typically comprises a container of cupped appearance, a lid likewise of cupped appearance hingedly associated with a rear top edge of the container, and a reinforcing frame disposed partly inside the container, which is anchored to a front face and to two side faces of the selfsame container.

It is standard practice in the case both of soft cigarette packets and of rigid cigarette packets to affix a revenue stamp functioning as a seal and indicating that the packet is subject to an excise duty in the country of sale.

It will be appreciated from the foregoing that the individual packet comprises a number of specific wrapping components, namely the inner wrapping and the outer wrapping, whether for cigarette packets of the soft type or for cigarette packets of the rigid type, also the revenue stamp, and the frame in the case of the rigid type packet.

Cigarette packets of the types described above are generally enveloped and sealed within a protective overwrapping of transparent plastic film material, typically polypropylene, that serves to create a substantially airtight enclosure and maintain a desired level of moisture internally of the packet. The overwrapping generally incorporates a ribbon designed to facilitate the operation of breaking open the packet by establishing a looped tear line that extends around the lateral faces adjacent to the end face, in the case of a soft type cigarette packet, or to the lid in the case of a rigid packet with a hinged lid.

It is also the practice in the tobacco industry to distribute packets of the two types in question with additional items such as cards, coupons and the like, bearing a variety of messages directed at the consumer. Such messages are often written, but more often pictorial, and might refer for example to competitions and prize draws or lotteries, and to other games of a similar nature.

These additional inserts, especially when bearing pictures relative to prize draws, lotteries and similar games, are associated with the respective packets internally or externally, as best expedient for the particular marketing requirement, and in such a way that the consumer will be able to see the illustrative content only after one or more obligatory unwrapping steps have been performed.

The decision to associate these additional inserts with single packets of cigarettes brings with it a serious cost drawback, in that special cigarette packaging machines have to be procured.

The object of the invention is to provide a packet for articles of elongated shape, tobacco products in particular, such as will afford a simple and economic solution to the drawback in question.

BRIEF SUMMARY OF THE INVENTION

A packet according to the present invention for articles of elongated shape is of the type comprising a first inner wrapper enveloping a group of the articles and a second outer wrapper placed around the first wrapper, the first and second wrappers constituting specific packaging components of the packet, also removable concealing means intended to mask at least one predetermined area of at least one of the specific packaging components, wherein the removable concealing means consist in a layer of opaque material that is removable by scratching.

BRIEF DESCRIPTION OF THE DRAWINGS

The invention will now be described in detail, by way of example, with the aid of the accompanying drawings, in which.

DETAILED DESCRIPTION OF THE INVENTION

Figure 1:
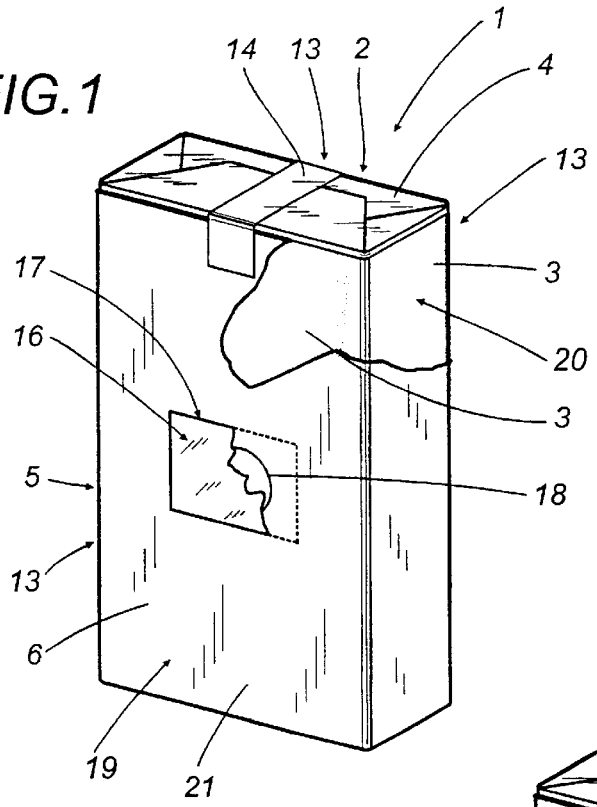
FIGS. 1 and 2 illustrate two respective embodiments of a soft type of packet for tobacco products according to the present invention, viewed in perspective with one part cut away for clarity.

In each of the packets 1 illustrated, the inner wrapper 2 is accommodated internally of an outer wrapper denoted 5; in the examples of FIGS. 1 to 4 which relate to a soft type of packet 1, the outer wrapper 5 appears as a label 6 enveloping all of the inner wrapper 2 except for the top end face 4, whereas in the examples of FIGS. 5 to 8 which relate to a packet 1 of the rigid type with a hinged lid, the outer wrapper 5 appears as a container 7 of cupped appearance surmounted by a lid 8, likewise of cupped appearance, hingedly associated with the container 7 along a rear edge 9 (visible only in FIG. 8) and rotatable thus between a position in which the packet 1 is closed (as in FIGS. 5, 6, 7 and 8) and a position in which the packet is open (not illustrated).

The rigid type of packet 1 also comprises an inner reinforcing frame 10 disposed partly inside the container 7, which is fixed to a front face 11 and two flank faces 12 of the selfsame container.

The single packet 1 is thus composed of specific packaging components 13, and more exactly the inner wrapper 2, the outer wrapper 5, whether a label 6 as in the case of the soft type of packet or a container 7 and lid 8 as in the case of the rigid type of packet, and the inner frame 10 likewise in the case of the rigid packet.

Each packet 1, be it of the soft type or the rigid type, exhibits a revenue stamp 14 constituting a further specific packaging component 13 that serves both to establish a seal when applied to the packet and to indicate that an excise duty is payable on the contents.

In the soft type of packet 1, the revenue stamp 14 is applied straddling the top end face 4 of the inner wrapper 2 and with the two longitudinal ends affixed to the top edge of the label 6, whereas in the rigid type of packet 1 the stamp 14 is applied to a rear face 15 of the wrapper 5, coinciding with the hinge edge 9.

Each packet 1 illustrated, soft type and rigid type alike, comprises a removable concealing element 16 designed to mask a predetermined area 17 of one of the specific packaging components 13 making up the packet 1. In practice, the concealing element 16 consists in a layer of opaque material that can be removed by scratching; and the hidden area 17 will exhibit at least one item of print, an image 18 in the example indicated, carrying a message targeted directly at the consumer, typically a competition or prize draw. The concealing element 16 is shown partly removed in FIGS. 1 to 8, in the interests of clarity.

Figure 2:
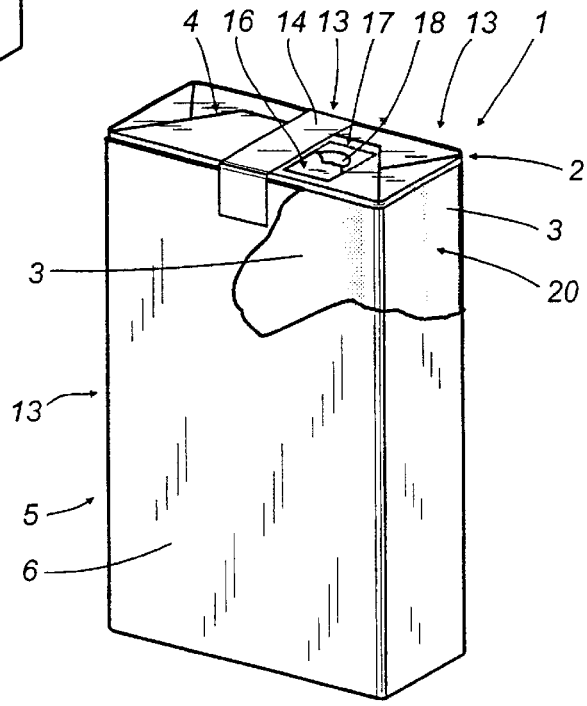
Figure 3:
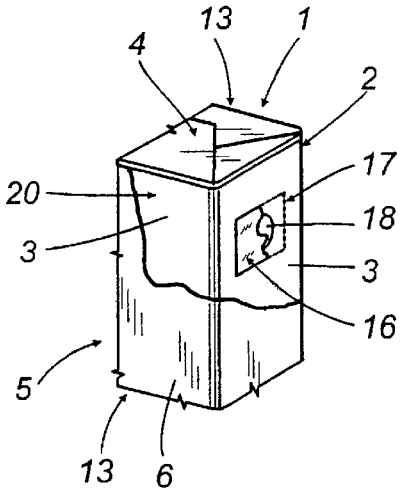
FIGS. 3 and 4 illustrate two further respective embodiments of a soft type of packet for tobacco products according to the present invention, viewed fragmentarily in perspective with one part cut away for clarity.
Figure 5:
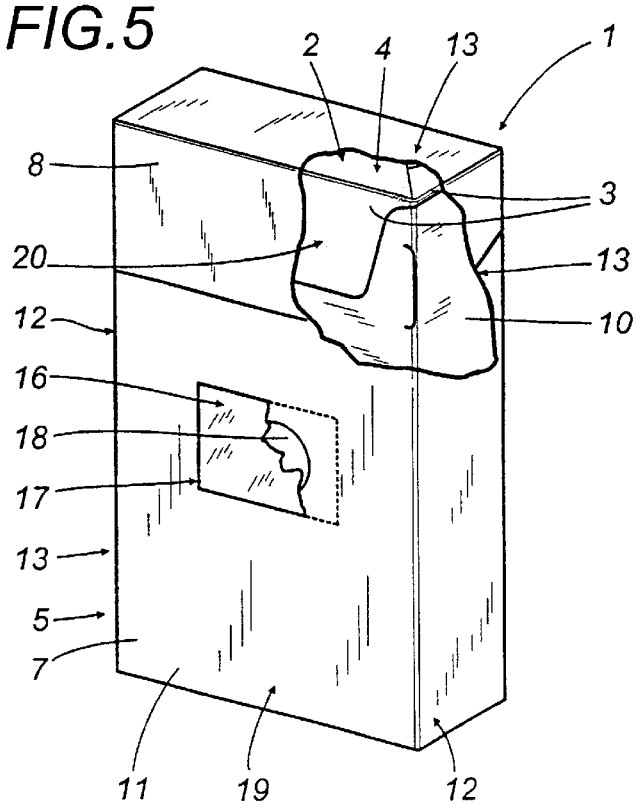
FIG. 5 illustrates an embodiment of a packet for tobacco products of the rigid type with a hinged lid, according to the present invention, viewed in perspective with one part cut away for clarity.
Figure 6:
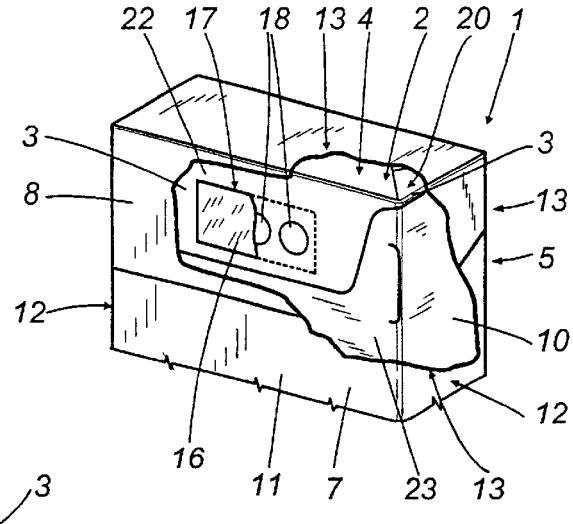
FIGS. 6, 7 and 8 illustrate three further respective embodiments of a rigid packet with a hinged lid according to the present invention, viewed fragmentarily in perspective with one part cut away for clarity.

In the examples of FIGS. 1 and 5, the concealing element 16 masks a predetermined area 17 afforded by the external surface 19 of the outer wrapper 5, whereas in FIGS. 2, 3 and 6 the element 16 conceals a predetermined area 17 afforded by the external surface 20 of the inner wrapper 2. More precisely, in the packet 1 of FIG. 1, the element 16 conceals a predetermined area 17 afforded by a front face 21 of the label 6; in the packet 1 of FIG. 5, the element 16 conceals a predetermined area 17 of a front face 11 of the container 7; in the packet 1 of FIG. 2, the element 16 conceals a predetermined area 17 of the top end face 4 of the inner wrapper 2; in the packet 1 of FIG. 3, the element conceals a predetermined area 17 afforded by a flank face 3 of the inner wrapper 2; and in the packet 1 of FIG. 6, the element 16 conceals a predetermined area 17 of the face 3 of the inner wrapper 2 that coincides with the front face 11 of the container 7. In this latter instance, the concealed area 17 forms part of a portion 22 of the relative side face 3 that projects from a front face 23 of the frame 10.

Figure 7:
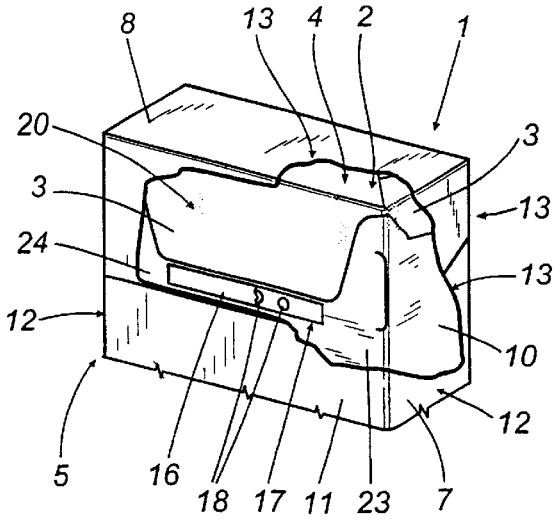

In the example of FIG. 7, the concealing element 16 masks a predetermined area 17 of the outer surface presented by the front face 23 of the frame 10. In particular, the area 17 in question forms part of a portion 24 of the face 23 that projects from the container 7.

Figure 4:
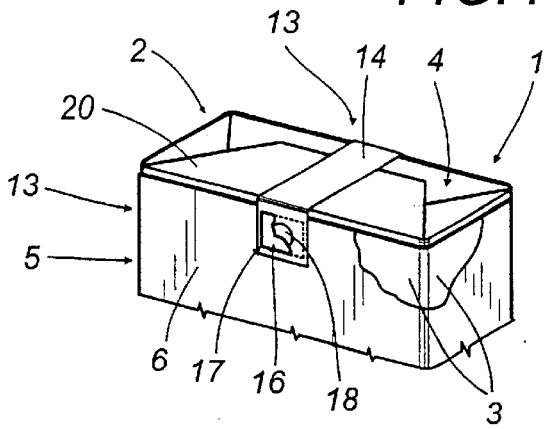
Figure 8:
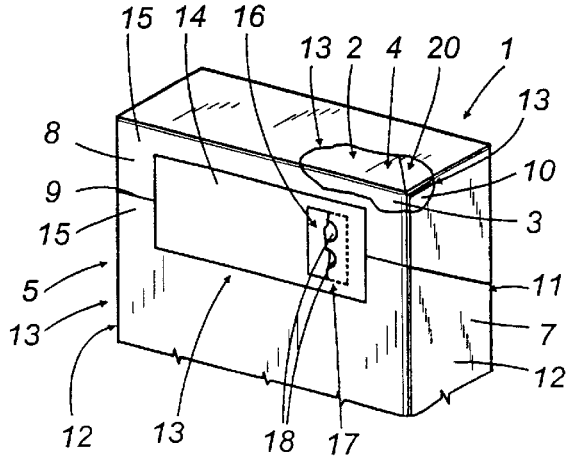

Finally, in the examples of FIG. 4 and FIG. 8, the concealing element 16 masks a predetermined area 17 of the external surface presented by the revenue stamp 14.

In other versions of the soft and/or rigid packet 1 (not illustrated), the element 16 might conceal a predetermined area 17 of the internal surface of the inner wrapper 2 and/or of the outer wrapper 5 and/or of the frame 10 and/or of the stamp 14.

Finally, the single packets 1 can be overwrapped in familiar manner with an additional outer sheet (not indicated) of transparent plastic material (such as polypropylene) of which the function is to create a substantially hermetic seal around the packet 1 and maintain a given level of moisture in the contents. Likewise in familiar manner, the plastic material can incorporate a tear ribbon (not indicated) that will extend in a loop around the side faces of the finished packet 1 and thus facilitate the operation of breaking open the overwrapping.

What is claimed is:

1. A packet for articles of elongated shape, comprising:

a first inner wrapper completely enveloping a group of the articles;

a second outer wrapper placed around the first inner wrapper, the second outer wrapper being a formed wrapper serving as a container for the first inner wrapper, the first and second wrappers constituting specific packaging components of the packet; and removable concealing means for masking at least one predetermined area of at least one of the specific packaging components, the removable concealing means comprising a layer of opaque material that is removable by scratching, wherein the removable concealing means is applied directly to and masks at least one predetermined area of an external surface of the second outer wrapper.

2. A packet as in claim 1, wherein the first inner wrapper and second outer wrapper are of a soft type such that the packet is of a soft type.

3. A packet for articles of elongated shape, comprising:

a first inner wrapper completely enveloping a group of the articles;

a second outer wrapper placed around the first inner wrapper, the second outer wrapper being a formed wrapper serving as a container for the first inner wrapper, the first and second wrappers constituting specific packaging components of the packet; and removable concealing means for masking at least one predetermined area of at least one of the specific packaging components, the removable concealing means comprising a layer of opaque material that is removable by scratching, the packet comprising a further specific packaging component consisting of a revenue stamp positioned externally of the external surface of the second outer wrapper, wherein the removable concealing means is applied directly to and masks at least one predetermined area of the stamp.

4. A packet as in claim 3, wherein the at least one predetermined area of the stamp masked by the removable concealing means is less than an entire area of the stamp.

5. A packet as in claim 4, wherein the first inner wrapper and second outer wrapper are of a soft type such that the packet is of a soft type.

6. A packet as in claim 3, wherein the first inner wrapper and second outer wrapper are of a soft type such that the packet is of a soft type.

* * * * *